United States Patent [19]

Murt

[11] 4,056,139

[45] Nov. 1, 1977

[54] HOLDER FOR MONEY, CARDS AND THE LIKE

[76] Inventor: Edward M. Murt, 831 Medway Road, Philadelphia, Pa. 19115

[21] Appl. No.: 663,298

[22] Filed: Mar. 3, 1976

[51] Int. Cl.[2] ..... A45C 11/18; B42F 1/00

[52] U.S. Cl. ..... 150/39; 24/81 MC; 24/67.3

[58] Field of Search ..... 24/81 MC, 67.3, 67.11, 24/81 WP, 81 AD, 81 A, 81 R, 2; 281/35, 17, 31; 150/38, 39

[56] References Cited

U.S. PATENT DOCUMENTS

| | | | |
|---|---|---|---|
| 316,586 | 4/1885 | Verbeck | 24/81 AZ |
| 549,890 | 11/1895 | Austin | 281/17 |
| 1,840,604 | 1/1932 | Randall | 24/67.11 |
| 1,851,013 | 3/1932 | Michaud | 24/67.11 |
| 2,186,943 | 1/1940 | Voss | 24/81 MC |
| 2,575,030 | 11/1951 | Smallman | 150/38 |
| 2,847,743 | 8/1958 | Voss | 24/81 MC |
| 3,120,041 | 2/1964 | Voss | 24/81 MC |
| 3,369,585 | 2/1968 | Martinsen | 24/81 MC |
| 3,416,586 | 12/1968 | Voss | 24;150/81 MC;38 |

*Primary Examiner*—Bernard A. Gelak
*Attorney, Agent, or Firm*—Nelson E. Kimmelman

[57] ABSTRACT

The holder includes at least one cover, usually rigid and planar, to which at least two clips are attached. One of the clips is secured to the side cover and the other is pivotally coupled thereto. In another form, a second clip is pivotally coupled to the cover.

A third form of the invention has one clip secured to one side cover and a second clip secured to a second side cover which is pivotally coupled to the first cover. A fourth embodiment has one cover pivotally coupled to another cover, each cover having secured thereto a clip, and an intermediate third clip spaced from said first and second clips and disposed for pivotal movement in a mounting which is coupled to the first cover.

13 Claims, 20 Drawing Figures

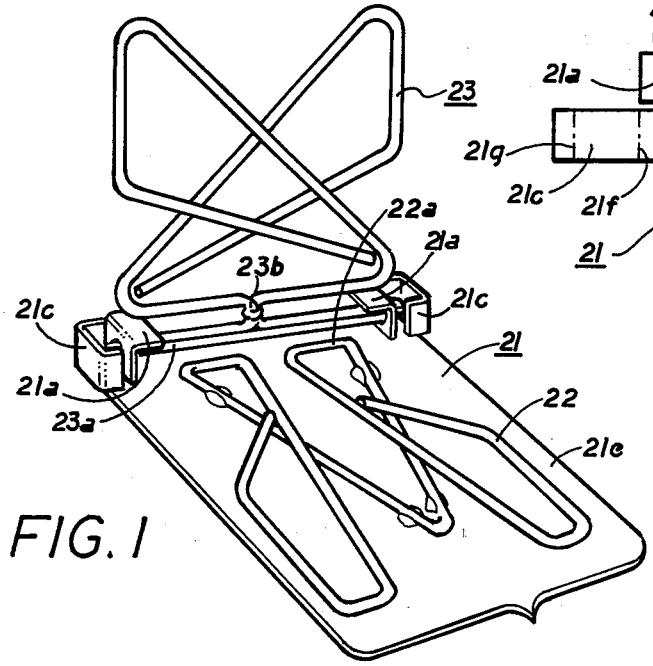
FIG. 1
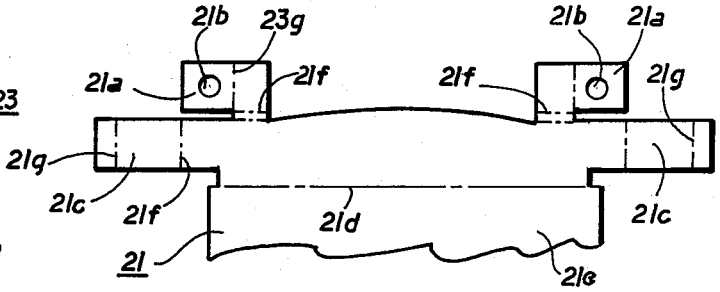
FIG. 2
FIG. 4
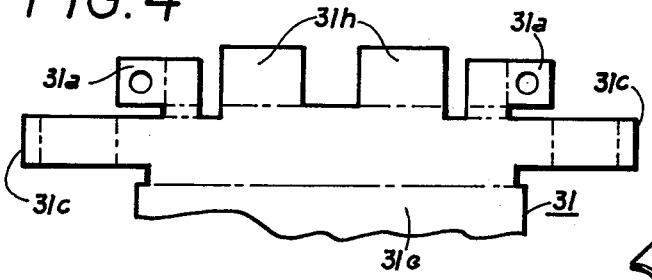
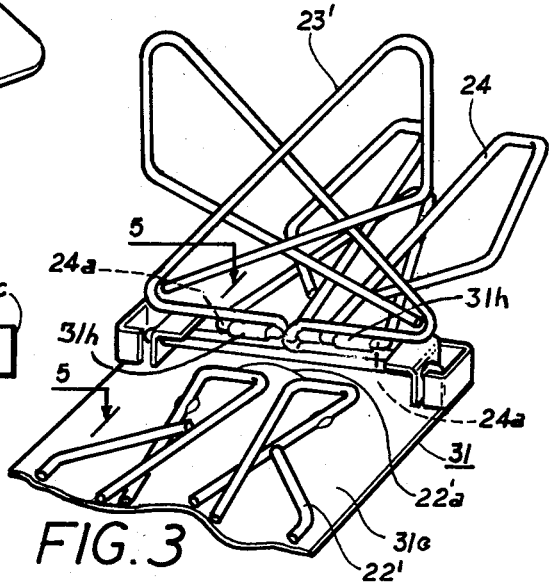
FIG. 3
FIG. 8
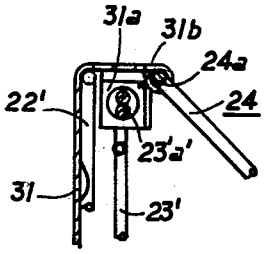
FIG. 5
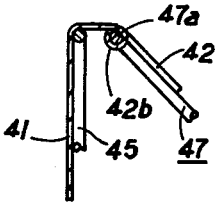
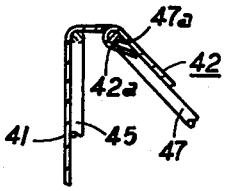
FIG. 9
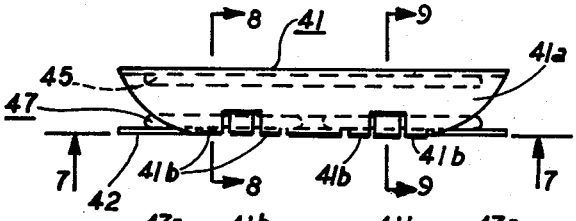
FIG. 6
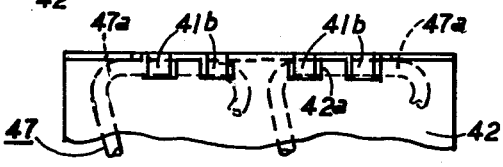
FIG. 7

FIG. 10
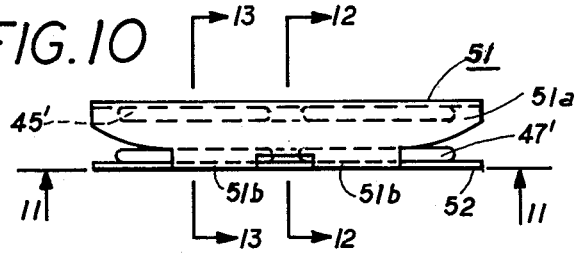
FIG. 12
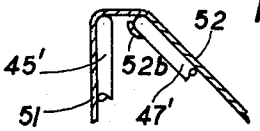
FIG. 11
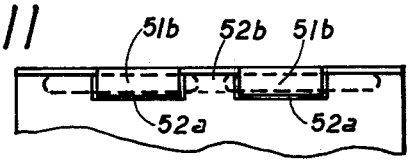
FIG. 13
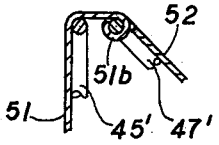
FIG. 14
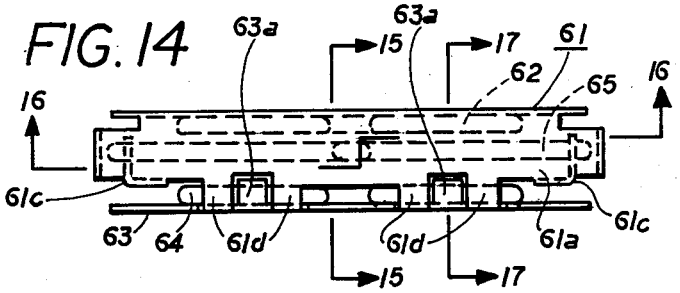
FIG. 15
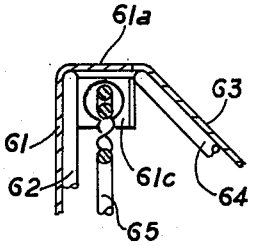
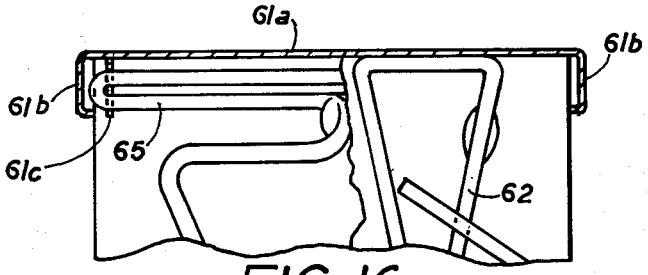
FIG. 16
FIG. 17
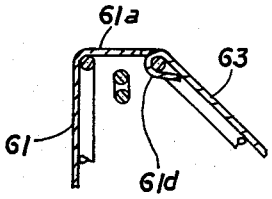
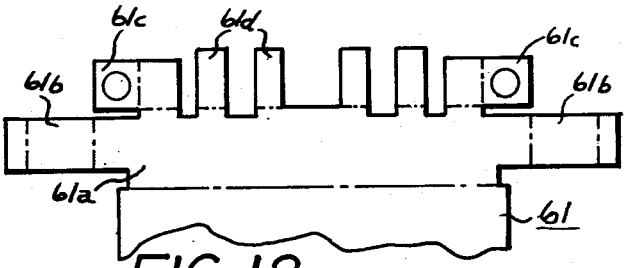
FIG. 18
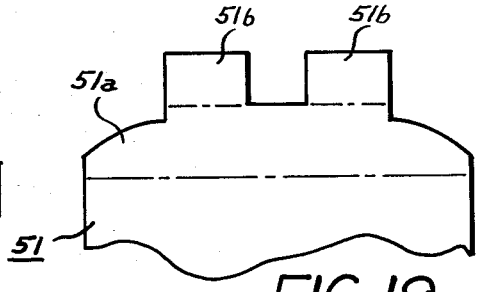
FIG. 19
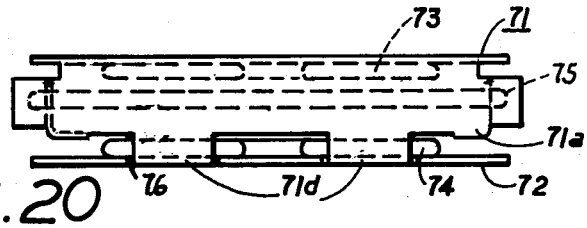
FIG. 20

HOLDER FOR MONEY, CARDS AND THE LIKE

BACKGROUND OF THE INVENTION

A. Field of the Invention

This invention relates to holders and in particular to a pocket holder for paper currency, cards and the like.

B. Prior Art

Simple money clips are known which are essentially U-sectioned members having essentially parallel sides that are biased toward one another and between which money is compressively held. However, these are not adequate for the purpose of holding several discrete wads of money or several separate categories of cards or money, etc. Furthermore, the actual clips are often unprotected by any covers. It is therefore an object of the present invention to provide a money or card holder with provisions for holding several discrete packs or wads of money, cards, or the like. It is another object of the present invention to provide a holder for money or cards or the like in which the actual retaining members are shielded by covers.

BRIEF SUMMARY OF THE INVENTION

A holder for money, cards or the like having at least one cover to which at least two clips are attached, one being secured to the inside surface of the cover and the other being pivotally coupled thereto. In one form, the cover is rigid and planar; in other forms more than two clips are attached or covers are employed, one cover being pivotally coupled to the other.

BRIEF DESCRIPTION OF THE DRAWINGS

FIG. 1 is a perspective view of one form of the invention having a single cover and two separate clips;

FIG. 2 is a fragmentary lay-out view of a portion of the cover of the apparatus shown in FIG. 1;

FIG. 3 is a fragmentary perspective view of another form of the invention having a single cover and three clips;

FIG. 4 is a fragmentary layout view of the upper portion of the cover shown in FIG. 3 before it has been formed;

FIG. 5 is a sectional view of the apparatus shown in FIG. 3 taken along the line 5—5 in the direction indicated;

FIG. 6 is a plan view from the top of still another form of the invention in which there are two covers and a clip adhered to the insides of each cover;

FIG. 7 is a fragmentary, side elevational view of the holder shown in FIG. 6 as viewed from the line 7—7 in FIG. 6 in the direction indicated;

FIG. 8 is a sectional view of the apparatus shown in FIG. 6 taken along the section line 8—8 in the direction indicated;

FIG. 9 is a sectional view of the apparatus shown in FIG. 6 taken along the section line 9—9 in the direction indicated;

FIG. 10 is a plan view from the top of another form of the clip similar to the embodiment of FIG. 6, but with a different hinge arrangement;

FIG. 11 is a fragmentary view of the apparatus shown in FIG. 10 taken along the line 11—11 in the direction indicated;

FIGS. 12 and 13 are respective fragmentary sectional views taken along the respective section lines 12—12 and 13—13 in FIG. 10;

FIG. 14 is a top view of still another form of the invention having two covers, a clip adhered to the inner surface of each cover, and an intermediate clip mounted for pivotal movement;

FIG. 15 is a fragmentary sectional view taken along the section line 15—15 of FIG. 14 in the direction indicated;

FIG. 16 is a fragmentary sectional view of the apparatus shown in FIG. 14 taken in the direction indicated by line 16—16 of FIG. 14;

FIG. 17 is a fragmentary sectional view taken along the line 17—17 in the direction indicated in FIG. 14;

FIG. 18 is a fragmentary lay-out view of one cover of the apparatus shown in FIG. 14;

FIG. 19 is a fragmentary layout view of a portion of one cover of the form of the invention shown in FIG. 10; and FIG. 20 is a plan view of still another form of the invention.

DETAILED DESCRIPTION OF THE DRAWINGS

Referring now to FIGS. 1 and 2, a first embodiment of the invention is shown comprising a first side cover 21, a first clip 22 adhered thereto by solder or other bonding agent and a second clip 23 pivotally attached to an end cover portion. The cover 21, before forming, has its upper portion as shown in FIG. 2 with two upper, oppositely placed short tabs **21*a*, each having perforations 21*b*. Just below them are two longer tab portions 21*c* disposed at opposite ends of an end cover portion between the cover 21*e* and the tabs 21*a*. The blank 21 is folded along the fold line 21*d* until the portion 21*e* is at right angles to the upper portion. Then the portions 21*a* are folded downward along the fold lines 21*f* until the tabs 21*a* are substantially parallel to the portion 21*e*. Then the lower portion 23*a* of the clip 23 lies on the longitudinal axis of the portion 21*e* between portions 21*a* and 21*e*. After the clip 23 is placed in position, the outer end portions of the tabs 21*a* are folded down along fold line 23*g* until they are at right angles to the portion 20*e* whereupon the apertures 21b are made to encircle the outer extremities of the lower clip portion 23*a* thereby confining the clip in place for pivotal movement. The portions 21*c* are folded inwardly along fold lines 21*f* until the portions 21*c* are parallel to one another, then they are folded inwardly again along the fold lines 21*g*.**

The embodiment of the invention shown in FIG. 3 also includes a cover designated generally at the numeral 21 whose upper portion, before forming, is shown in FIG. 4. This upper portion is substantially similar to the one shown in FIG. 2 except that it has two additional tabs **31*h* positioned between the portions 31*a* that correspond to portions 21*a* in the previous embodiment. Similarly, the portions 31*c* correspond generally to the portions 21*c* in the previous embodiment. Other corresponding portions are numbered the same, but bear a prime. It is seen that the additional tabs 31*h* fold over and engage the two coaxial portions 24*a* of the third clip 24 that correspond to the portions 22'a of the clip 22'. Thus, clips 23' and 24 can freely pivot, each holding its own set of cards or wad of money just as the clip 22'** does.

FIGS. 6 through 9 depict still another variation which has two covers hinged to one another and separate clips adhered to the inside surface of each cover. Thus, there is a first cover 41 having a bent-over portion 41a and a second cover 42. Each cover has a clip, numbered 45 and 47 respectively, secured to the inside surface of the cover. The cover 41, as shown in FIGS. 7 and 8, has four curled-over portions **41*b* that surround the top portions 47*a* of the clip 47. Similarly, the cover 42 has curled-over portions 42*a* surrounding the portions 47*a* to help in securing the clip 47 to the cover 42** resulting in a piano-hinge-like coupling. Thus, the assembly includes two covers and two clips respectively coupled to the insides of the covers, the second cover being pivotally connected to the first.

FIGS. 10–13 show still another form of the invention quite similar to the form of FIGS. 6–9 except for the coupling hinge. Primed numerals correspond to unprimed numerals in earlier figures. Here there are two covers 51 and 52, 51 having a bent over portion **51*a* and portions 51*b* that curl around the top portions of the clip 47' secured to the inner surface of the cover 52. Cover 52 is provided with cut-outs 52*a* which are filled by the portions 51*b* substantially in the same fashion as the portions 41*b* occupy the cut-out portions 42*a* in FIG. 7.**

FIGS. 14–18 show still another form having two covers, a clip secured to the inside surface of each cover, and a pivoting intermediate clip attached to the first cover. Thus, cover 61, whose layout is shown in FIG. 18, has a clip 62 secured to its inside surface. It also has a right-angled top portion **61*a* having two downwardly-disposed portions 61*b* which cover the exposed ends of the intermediate clip 65 whose ends pass through apertures in portions 61*c*. The other cover 63 has secured to its inner surface a clip 64 which is engaged at four points at the top by portions 61*d* through appropriate cut-out portions of the cover 63 in a manner similar to that shown in FIGS. 6 and 7. The cover 63 also has two portions 63*a* which encircle the top portions of the clip 64 to help secure it to the cover 63, also in a fashion similar to that shown in FIGS. 6 and 7. The mounting of the intermediate clip 65 for pivotal movement is substantially the same as shown in the mounting of the clip 23' in FIG. 3 as depicted in FIGS. 15 and 16.**

FIG. 18 shows another form of a two cover, three-clip assembly very similar to the embodiment of FIGS. 14–18 except that the "piano-hinge" type coupling of the latter embodiment is replaced by a strap-type hinge similar to the hinging of the covers in the embodiments shown in FIGS. 10 and 11. There are first and second covers 71 and 72 with clips 73 and 74 respectively secured to their inside surfaces in the usual manner. There is a bent-over portion **71*a* which is formed substantially the same as the corresponding portions 61*a* of the embodiment of FIG. 14 except that instead of having four portions 61d which curl over the top of the clip 74 as in the embodiment of FIG. 14, there are only two wide portions 71d that occupy cut-out portions in the top edge of the cover 72.**

FIG. 20 shows still another form of the invention which is quite similar in most respects to the embodiment shown in FIGS. 14–18 having a first cover 71 which has a bent-over portion **71*a* and a second cover 72 as well as a first clip 73 secured to the inner surface of the cover 71. A second clip 74 is mounted for pivotal movement substantially identical to the construction shown for the intermediate clip 65 in FIG. 14. A third clip 75 is adhered to the inner surface of the wall 72. However, instead of having the four curled-over portions 61*d* as in the embodiment shown in FIG. 14, there are two larger portions 71*d* which curl around the upper part of the clip 74 in substantially the same manner as the portions 51*b* do around the upper part of the clip 47' in the embodiment shown in FIGS. 10 and 11. The portions 71*d* are disposed within the cut-out portions 76 formed in the upper part of the cover 72 similar to the cut-out parts 52*a* in the embodiment of FIGS. 10 and 11.**

While the embodiments having a single pivoting intermediate clip such as the clip 23' in FIG. 3, the clip 65 in FIG. 14 and the clip 75 in FIG. 20, it should be appreciated that the portions **31*a*, for example, in FIG. 4, could be made larger to accommodate several perforations which can be used to mount more than one pivoting intermediate clip. In such case, the portions 31*c*** covering the exposed ends of the clip can also be made larger to cover the extremities of several rather than one intermediate pivoting clip.

Still other forms of the invention will occur to one skilled in the art upon perusal of this specification and drawings, such other forms not departing from the essence hereof. Consequently, I desire that my invention be limited solely by the claims which follow:

I claim:

1. A holder for money, cards, or the like comprising:

a. a side cover, b. a first clip substantially immovably secured directly to the inside surface of said side cover, said clip having two portions normally urged resiliently into contact with one another and lying in generally parallel adjacent planes, said two portions clasping said money or the like between them, and c. a second clip having two generally parallel portions normally urging resiliently toward one another to clasp money or the like between them, said second clip being spaced from said first clip and disposed for pivotal movement and to lie over said first clip in a generally parallel relation thereto in a mounting which is connected to said side cover and spaced from said first clip.

2. The holder according to claim 1 wherein said side cover is substantially planar.

3. The holder according to claim 1 wherein said side cover is substantially rigid.

4. The holder according to claim 1 with the addition of a second side cover pivotally coupled to said first cover.

5. The holder according to claim 1 with the addition of a third clip spaced from said first and second clips and disposed for pivotal movement in a mounting which is coupled to said cover.

6. The holder according to claim 4 wherein said second side cover has secured to it a second clip on its inner surface.

7. The holder according to claim 6 wherein there is at least one other clip disposed intermediate said first and second clips, said intermediate clip being disposed for pivotal movement in a mounting which is coupled to at least one of said side covers.

8. The holder according to claim 1 wherein there is a rigid end cover portion disposed adjacent to and substantially at right angles to said first side cover.

9. The holder according to claim 8 with the addition of two tab portions respectively attached to opposite ends of said end cover portion.

10. The holder according to claim 5 wherein said third clip is disposed within curled-over tabs formed at an outer edge of said end cover portion.

11. The holder according to claim 6 wherein there is an end cover portion disposed adjacent to and substantially at right angles to said first side cover, wherein said end cover portion has at least one curled-over tab formed at one of its outer edges and wherein at least one straight portion of said second clip arranged on the pivoting axis of said second clip is disposed within said curled-over tab at the outer edge of said end cover portion.

12. The holder according to claim 8 wherein said end cover portion is formed integrally with said first side cover.

13. The holder according to claim 11 wherein said end cover portion is formed integrally with said first side cover.

* * * * *